US006080716A

United States Patent [19]

Sköld et al.

[11] Patent Number: 6,080,716

[45] Date of Patent: Jun. 27, 2000

[54] ALKALINE DETERGENT HAVING HIGH CONTENTS OF NONIONIC SURFACTANT AND COMPLEXING AGENT, AND USE OF AN AMPHOTERIC COMPOUND AS SOLUBILIZER

[75] Inventors: Rolf Sköld; Gunvor Karlsson, both of Stenungsund; Karin Hammarstrand, Kode, all of Sweden

[73] Assignee: Akzo Nobel N.V., Arnhem, Netherlands

[21] Appl. No.: 08/913,404

[22] PCT Filed: Mar. 4, 1996

[86] PCT No.: PCT/SE96/00277

§ 371 Date: Oct. 31, 1997

§ 102(e) Date: Oct. 31, 1997

[87] PCT Pub. No.: WO96/29384

PCT Pub. Date: Sep. 26, 1996

[30] Foreign Application Priority Data

Mar. 21, 1995 [SE] Sweden ..... 9500983

[51] Int. Cl.[7] ..... C11D 1/88; C11D 1/722

[52] U.S. Cl. ..... 510/490; 510/126; 510/128; 510/341; 510/356; 510/413; 510/421; 510/480; 510/501

[58] Field of Search ..... 510/126, 128, 510/490, 480, 501, 421, 413, 356, 341

[56] References Cited

U.S. PATENT DOCUMENTS

| | | | |
|---|---|---|---|
| 3,912,662 | 10/1975 | Martinsson et al. | 252/527 |
| 3,956,161 | 5/1976 | Woodward | 252/156 |
| 4,670,179 | 6/1987 | Inamorato et al. | 252/174 |
| 5,051,212 | 9/1991 | Culshaw et al. | 252/546 |
| 5,132,053 | 7/1992 | Crossin | 252/546 |
| 5,331,100 | 7/1994 | Smith et al. | 564/468 |

FOREIGN PATENT DOCUMENTS

| | | | |
|---|---|---|---|
| 0 105 063 | 4/1984 | European Pat. Off. | C11D 3/43 |
| WO93/23158 | 11/1993 | WIPO | C11D 1/83 |

OTHER PUBLICATIONS

*GOSIP*, Cesio International Surfacants Congress & Exhibition—A World Market, Jun. 1–5, 1992.

*Primary Examiner*—Yogendra Gupta
*Assistant Examiner*—Charles Boyer
*Attorney, Agent, or Firm*—Ralph J. Mancini; Lainie E. Parker

[57] ABSTRACT

The present invention relates to the use of an amphoteric compound as solubilizer and discloses an alkaline concentrate in the form of a clear aqueous solution which, after diluting with water, is suitable for use as detergent and which contains as least 4% by weight of a nonionic alkoxylate surfactant containing 2–12, preferably 3–10 alkyleneoxy groups having 2–4 carbon atoms, at least 50% of the alkyleneoxy groups being ethyleneoxy groups, at least 13% of a complexing agent, and 1–15% by weight of an amphoteric compound.

22 Claims, No Drawings

ALKALINE DETERGENT HAVING HIGH CONTENTS OF NONIONIC SURFACTANT AND COMPLEXING AGENT, AND USE OF AN AMPHOTERIC COMPOUND AS SOLUBILIZER

The present invention relates to an alkaline detergent concentrate with high contents of a nonionic surfactant and a complexing agent and in the form of a clear aqueous solution which, after diluting with water, is suitable for use as detergent for hard surfaces, dishwashing and textile washing. As solubiliser, the concentrate contains an amphoteric compound.

It is generally desirable that concentrates of alkaline detergent compositions can be produced in the form of clear solutions having high contents of surfactants and complexing agents and/or alkali. Thus, it is known from WO 93/23158 to solubilise alkaline detergent concentrates containing 5% by weight of a nonionic surfactant by using a mixture of a dimeric or oligomeric fatty acid and a $C_6$–$C_{12}$ fatty acid as solubiliser. EP-A-105,063 discloses alkaline detergent compositions for hard surfaces, the compositions having high contents of surfactant and complexing agent. As solubiliser, use is made of water-soluble salts of low-molecular organic acids, such as sodium or potassium salts of toluene, benzene, cumene sulfonic acid and sodium and potassium salts of sulfonsuccinic acid. In addition to the solubiliser, use is also made of conventional organic solvents. U.S. Pat. No. 3,956,161 discloses the use of salts of a $C_{21}$ dicarboxylic acid as solubiliser for an alkaline nonionic detergent concentrate. U.S. Pat. No. 5,051,212 discloses a detergent composition for hard surfaces, containing 6–10% of a surfactant and 16–24% of a binary mixture of solvent and complexing agent. The solvent usually is a $C_1$–$C_3$ alcohol, a $C_6$–$C_9$ alkylaromatic hydrocarbon or a diol having 6–16 carbon atoms. In all the examples, the greater part of the surfactant is an anionic surfactant. In no case does a nonionic surfactant constitute more than 2% of the concentrate. Other commonly used solubilisers in detergent compositions are alkyl phosphate compounds, amphoteric compounds or fatty alkyl aminoethoxylate having 8–14 carbon atoms in the alkyl group. The publication 3rd Cesio International Surfactants—a World Market; Proceedings Section D, Applications, pp 312–313, thus describes that amphoteric compounds have a solubilising effect on nonionic systems in concentrates with moderate contents of both nonionic surfactant and complexing agent.

The object of the present invention is to be able to formulate an alkaline detergent concentrate in the form of a clear solution in water. The concentrate should contain a very high content of nonionic surfactant and complexing agent and should, after diluting with water, be suitable for use as detergent for, among other things, hard surfaces, dishwashing and textile washing. A further object is that the concentrate has the form of a solution within a wide temperature range. Since concentrates having high contents of nonionic surfactant have inverted solubility, i.e. the solubility decreases as the temperature increases, the concentrates should have the form of a clear solution, at least up to 40° C., preferably up to 50° C., most advantageously up to 80° C.

It has now surprisingly been found that the desiderata stated above can be achieved by using as solubiliser an amphoteric compound as solubility mediator. The alkaline concentrate according to the invention, which is in the form of a clear aqueous solution and which, after deluting with water, is suitable for use as detergent, contains at least 4% by weight of a nonionic alkoxylate surfactant containing 2–12, preferably 3–10 alkyleneoxy groups having 2–4 carbon atoms, at least 50% of the alkyleneoxy groups being ethyleneoxy groups, at least 13% by weight of a complexing agent, and 1–15% by weight of an amphoteric compound having the formula

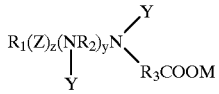

(II)

wherein $R_1$ is a hydrocarbon group having 4–20 carbon atoms, Z is the group CO, a group $(B)_nOCH_2CH(OH)CH_2$, wherein B is an oxyalkylene group having 2–4 carbon atoms and n is from 0 to 5, or the group $CH(OH)CH_2$, z is 0 or 1, $R_2$ is the group —$C_2H_4$—, or the group —$C_3H_6$—, Y is hydrogen or a group $R_3COOM$, y is 0–3, with the proviso that when z is 1 and Z is the group CO, y is 1–3, $R_3$ is —$CH_2$— or —$C_2H_4$— and M is hydrogen or a cation, as solubiliser. The amphoteric compound having the formula (II) has a surprisingly good solubility and renders it possible to prepare concentrates which have the form of a clear solution at temperatures in the range of 40–80° C. and which contain about 5% of a nonionic surfactant, and 40% by weight of a complexing agent or about 10% of a nonionic surfactant and 30% of a complexing agent, while using a relatively small amount of the solubiliser. Preferably, the amount of nonionic alkylate surfactant and complexing agent is at least 24% by weight of the concentrate. Consequently, the active contents in the concentrate may be significantly increased as compared to prior art technique. It has also been found that by the presence of the amphoteric compound, the concentrates have a cleaning effect which is significantly better than can be expected on the basis of the included nonionic alkoxylate surfactant and the included complexing agent.

The nonionic alkoxylate surfactant may consist of compounds having the formula $$RO(A)_xH \quad \text{(Ia)}$$

wherein R is a hydrocarbon having 8–18 carbon atoms, x is from 2 to 12, preferably 3–10, and A is an alkyleneoxy group having 2–4 carbon atoms, the number of ethyleneoxy groups being at least 50% of the total number of alkyleneoxy groups.

The hydrophobic group R may thus be aromatic as well as aliphatic, and it may be branched or straight, saturated or unsaturated. Examples of suitable hydrocarbon groups are 2-ethylhexyl, octyl, decyl, cocoalkyl, lauryl, oleyl, rape alkyl, tallow alkyl, octylphenol and nonylphenol. Preferably, all alkyleneoxy groups are ethyleneoxy groups. The nonionic surfactant having the formula (1a) can be prepared by reacting 2–12, preferably 3–10 mole ethylene oxide with 1 mole alcohol. The alkoxylating can be carried out with ethylene oxide or by a mixture of ethylene oxide and higher alkylene oxide or by reacting ethylene oxide and higher alkylene oxide in blocks.

Preferably, the surfactant having the formula (Ia) is a compound in which an aliphatic alcohol having 8–14 carbon atoms is ethoxylated with 3–6 mole ethylene oxide per mole alcohol, suitably in the presence of a catalyst, such as $Ca(OH)_2$, $Ba(OH)_2$, $Sr(OH)_2$ and hydrotalcite, which gives a narrow distribution of ethylene oxide and low contents of unreacted alcohol. If desired, it is possible, for the purpose of obtaining lower foaming, after the ethoxylation to react for example 1 or 2 mole propylene oxide or butylene oxide per mole ethoxylate. The aliphatic alcohol having 8–14 carbon atoms preferably consists of oxoalcohols, Guerbet alcohols, methyl-substituted alcohols with 2–4 groups having the formula —$CH(CH_3)$— included in the alkyl chain and straight alcohols.

Other suitable nonionic alkoxylate surfactants are those having the formula (Ib)

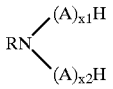

wherein R is a hydrocarbon group or an acyl group having 8–18 carbon atoms, A has the meaning stated in Formula (Ia), and $x_1$ and $x_2$ are, independently of each other, 0–12, the sum of $x_1$ and $x_2$ being 2–12, preferably 3–10. The hydrocarbon group and the acyl group can be aromatic or aliphatic, or branched, saturated or unsaturated. Examples of suitable groups are 2-ethylhexyl, octyl, decyl, cocoalkyl, lauryl, oleyl, rape alkyl, tallow alkyl, octylphenol and nonylphenol and the corresponding aliphatic acyl groups. Especially suitable hydrocarbon groups and acyl groups are those having 8–14 carbon atoms, obtained from oxoalcohols, Guerbet alcohols, methyl-substituted alcohols with 2–4 groups having the formula —$CH(CH_3)$— included in the alkyl chain and straight alcohols as well as the corresponding carboxylic acids. If R in the formula (Ia) is an acyl group, preferably one of $x_1$ and $x_2$ is 0, whereas if R in the formula (Ib) is a hydrocarbon group, i.e. when the nitrogen atom is an amine nitrogen, $x_1$ and $x_2$ are both preferably different from zero.

The amphoteric compund, which usually is 2–10% by weight of the concentrate, preferably consists of compounds in which the number of $R_3COOM$ groups is at least 2, M preferably being a monovalent cation, such as an alkali ion or an organic ammonium ion. The designation y preferably is 0–2. The hydrocarbon group $R_1$ preferably is an aliphatic group having 6–14 carbon atoms. If $R_1$ is a hydrocarbon group having more than 14 carbon atoms, these are preferably unsaturated, aliphatic hydrocarbon groups. Specific examples of suitable $R_1$ groups or $R_1CO$ groups are 2-ethylhexyl, octyl, 3-propylheptyl, decyl, dodecyl, oleyl, cocoalkyl and tallow alkyl and the corresponding acyl groups. Examples of suitable amphoteric compounds are compounds having the formulae (III)

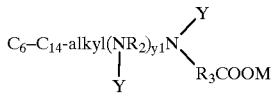

wherein $R_2$, $R_3$, M and Y have the meaning stated in formula (II) and $Y_1$ is 0–2, preferably 0 or 1, the number of $R_3COOM$ groups being at least 2, (IV)

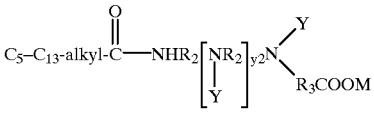

wherein $R_2$, $R_3$, Y and M have the meaning stated in formula (II) and $Y_2$ is 0 or 1, the number of $R_3COOM$ groups being at least 2, (V)

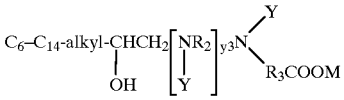

wherein $R_2$, $R_3$, Y and M have the meaning stated in formula (II), and $y_3$ is 0–2, preferably 0 or 1, the number of $R_3COOM$ groups being at least 2, (VI)

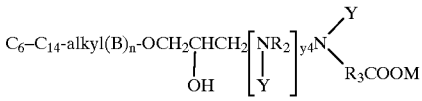

wherein $R_2$, $R_3$, B, Y, M and n have the meaning stated in formula (II), and $y_4$ is 0–2, preferably 0 or 1, the number of $R_3COOM$ groups being at least 2. B is preferably an ethyleneoxy group, and n is preferably 0 or 1.

The complexing agents in the concentrate can be inorganic as well as organic. The inorganic complexing agents are mainly alkali salts of silicates and phosphates, such as sodium tripolyphosphate, sodium orthophosphate, sodium pyrophosphate, sodium phosphate, polymer sodium phosphates and the corresponding potassium salts. The organic complexing agents are mainly alkaline aminopolyphosphonates, organic phosphates, polycarboxylates, such as citrates, and aminocarboxylates. Examples of aminocarboxylates are sodium nitrilotriacetate (NTA), sodium ethylenediaminetetraacetate (EDTA), sodium diethylenetriaminepentaacetate (DTPA), sodium 1,3-propylenediaminetetraacetate (PDZ) and sodium hydroxyethylethylenediaminetriacetate (HEDTA). The amount of complexing agents in the concentrate may be as high as 50%.

In addition to the nonionic alkoxylate surfactant, the complexing agent and the amphoteric solubilising compound, the concentrate may have a number of different supplementary additives, such as anionic surfactants, for example $C_9$–$C_{16}$-alkylbenzene sulphonates, $C_9$–$C_{18}$-paraffin sulphonates, $C_{12}$–$C_{18}$ -olefin sulphonates, $C_{10}$–$C_{18}$-alkyl sulphates and soaps, amphoteric and zwitterionic surfactants, cationic surfactants and nonionic surfactants other than the alkoxylates described above.

Other additives are thickening agents, such as polyacrylates, carboxymethylcellulose, methylhydroxyethylcellulose, methylcellulose, hydroxyethylcellulose, ethylhydroxyethylcellulose and methylethylhydroxyethylcellulose, perfumes, colourants, reprecipitation-inhibiting agents, defrosting stabilisers, solvents, preservatives, pesticides etc.

The invention will now be described in more detail by means of the Examples below.

EXAMPLE 1

Different amounts of a solubiliser according to Table 1 were added to alkaline detergent compositions containing 5 alternatively 10% by weight of a nonionic surfactant, based on a tridecyl alcohol with which 10 mole ethyleneoxide per mole alcohol had been reacted in the presence of KOH as catalyst, different amounts of tetrapotassium phosphate, trisodium nitrilotriacetate and tetrasodium ethylenediaminetetraacetate, thereby determining the clearness of the various compositions. The results obtained are shown in Tables 2 and 3.

TABLE 1

| Amphotreric compound | Code |
|---|---|
| 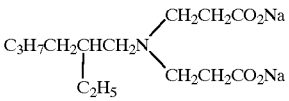 | 1 |
| 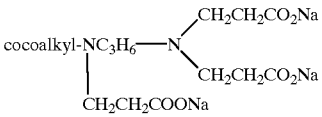 | 2 |
| 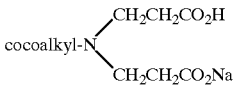 | 3 |
| 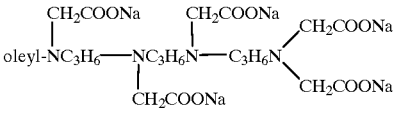 | 4 |
| 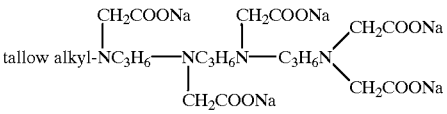 | 5 |
| 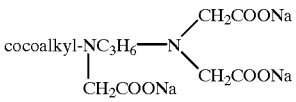 | 6 |
| 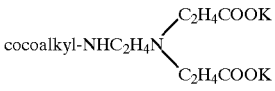 | 7 |
| 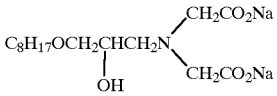 | 8 |
| 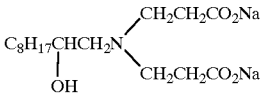 | 9 |

TABLE 1-continued

| Amphotreric compound | Code |
|---|---|
| 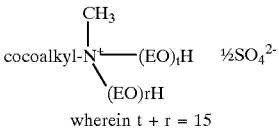 | A |
| Cumene sulphonate | B |

TABLE 2

| 5% Nonionic surfactant | | | | | |
|---|---|---|---|---|---|
| Solubiliser | | | | | Clearness |
| Code | % | TKPP | NTA | EDTA | ° C. |
| 1 | 8.0 | 20 | | | 80 |
| 1 | 7.2 | | 30 | | 50 |
| 1 | 7.2 | | | 30 | 50 |
| 2 | 3.9 | 20 | | | >80 |
| 2 | 3.0 | | 25 | | 70 |
| 2 | 6.0 | | | 30 | 58 |
| 3 | 3.5 | 20 | | | 80 |
| 3 | 3.3 | | 30 | | 60 |
| 3 | 6.0 | | | 35 | 60 |
| 4 | 8.0 | 20 | | | 80 |
| 4 | 5.2 | | 20 | | 60 |
| 4 | 5.2 | | | 20 | 60 |
| 5 | 5.6 | 20 | | | >80 |
| 5 | 6.0 | | 20 | | 75 |
| 5 | 6.0 | | | 20 | 75 |
| 6 | 6.8 | 20 | | | >80 |
| 6 | 5.2 | | 20 | | 80 |
| 6 | 6.8 | | | 25 | 42 |
| 7 | 5.4 | | 25 | | >80 |
| 8 | 7.8 | | 30 | | 40 |
| 9 | 9.0 | | 35 | | 60 |
| A | 20 | 20 | | | Turbid |
| A | 20 | | 20 | | Turbid |
| A | 20 | | | 20 | Turbid |
| B | 8.0 | 20 | | | Turbid |
| B | 6.0 | | 20 | | 70 |
| B | 6.0 | | | 20 | 70 |

TABLE 3

| 10% Nonionic surfactant | | | | | |
|---|---|---|---|---|---|
| Solubiliser | | | | | Clearness |
| Code | % | TKPP | NTA | EDTA | ° C. |
| 1 | 7.6 | 15 | | | >80 |
| 1 | 8.0 | | 25 | | 55 |
| 1 | 8.0 | | | 25 | 55 |
| 2 | 4.8 | 15 | | | >80 |
| 2 | 3.6 | | 20 | | 55 |
| 2 | 3.6 | | | 20 | 55 |
| 3 | 5.4 | 15 | | | 75 |
| 3 | 4.5 | | 20 | | 40 |
| 3 | 4.5 | | | 20 | 40 |
| 4 | 7.2 | 15 | | | 70 |
| 4 | 7.2 | | 20 | | 40 |
| 4 | 7.2 | | | 20 | 40 |
| 5 | 8.0 | 15 | | | >80 |
| 5 | 4.0 | | 15 | | 40 |
| 5 | 4.0 | | | 15 | 40 |
| 6 | 7.6 | 15 | | | >80 |
| 6 | 4.0 | | 15 | | 45 |
| 6 | 3.6 | | | 15 | 42 |

TABLE 3-continued

| 10% Nonionic surfactant | | | | | |
|---|---|---|---|---|---|
| Solubiliser | | | | | Clearness |
| Code | % | TKPP | NTA | EDTA | ° C. |
| 7 | 5.4 | | 25 | | >80 |
| 8 | 7.8 | | 25 | | 45 |
| 9 | 9.0 | | 25 | | 55 |
| A | 20 | 15 | | | Turbid |
| A | 20 | | 15 | | Turbid |
| A | 20 | | | 15 | Turbid |
| B | 10 | 15 | | | Turbid |
| B | 7.2 | | 15 | | 40 |
| B | 7.2 | | | 15 | 40 |

The inventive solubilisers showed an enhanced ability of solubilising large amounts of a nonionic surfactant in combination with a complexing agent as compared to the amine ethoxylate and the cumene sulphonate.

EXAMPLE 2

Different amounts of a solubiliser according to Table (I) were added to alkaline detergent compositions containing 5 alternatively 10% by weight of a nonionic surfactant, based on a synthetic primary $C_{9-11}$ alcohol having a linearity of above 80% by weight with which 5 mole ethylene oxide per mole alcohol had been reacted in the presence of $Ca(OH)_2$, i.e. a narrow-range-catalyst, different amounts of tetrapotassium phosphate, trisodium nitrilotriacetate and tetrasodium ethylenediaminetetraacetate, thereby determining the clearness of the different compositions. The results obtained are shown in Tables 4 and 5.

TABLE 4

| 5% Nonionic surfactant | | | | | |
|---|---|---|---|---|---|
| Solubiliser | | | | | Clearness |
| Code | % | TKPP | NTA | EDTA | ° C. |
| 1 | 6.0 | 30 | | | 80 |
| 1 | 6.0 | | 40 | | 50 |
| 1 | 6.0 | | | 50 | 80 |
| 2 | 6.0 | 30 | | | 80 |
| 2 | 6.0 | | 35 | | >80 |
| 2 | 6.0 | | | 40 | >80 |
| 5 | 12.0 | | | 35 | >80 |
| 5 | 8.0 | | 25 | | >80 |
| 6 | 7.2 | 20 | | | 80 |
| 7 | 4.6 | | 35 | | >80 |
| 8 | 6.7 | | 30 | | 45 |
| 9 | 5.7 | | 35 | | >80 |
| A | 20 | 20 | | | Turbid |
| A | 20 | | 20 | | Turbid |
| A | 20 | | | 20 | Turbid |
| B | 8.0 | 20 | | | Turbid |
| B | 6.8 | | 25 | | 80 |
| B | 8.0 | | | 30 | 80 |

TABLE 5

| 10% Nonionic surfactant | | | | | |
|---|---|---|---|---|---|
| Solubiliser | | | | | Clearness |
| Code | % | TKPP | NTA | EDTA | ° C. |
| 1 | 8.0 | 20 | | | 50 |
| 1 | 6.8 | | 35 | | 45 |
| 1 | 7.6 | | | 40 | 45 |
| 7 | 3.8 | | 25 | | >80 |
| 8 | 6.7 | | 30 | | 45 |
| 9 | 9.0 | | 30 | | 80 |
| A | 5.0 | | 10 | | 40 |
| A | 12.0 | | | 15 | 40 |
| B | 5.6 | 10 | | | Turbid |
| B | 6.4 | | 15 | | 50 |
| B | 6.0 | | | 15 | 50 |

As is evident from the results, the amphoteric compounds, without exception, were at least equivalent to or better than the reference products as solubiliser.

EXAMPLE 3

White lacquered metal plates were soiled with an oil black mixture obtained from diesel engines. The reflectance of the metal plates was measured by means of a colour reflectometer Minolta Chroma Meters CR-200 before and after cleaning with two different alkaline detergents of the following composition.

TABLE 6

| | Composition, % by weight | |
|---|---|---|
| Component | I | II |
| Nonionic surfactant (Example 2) | 5 | 5 |
| NTA | 25 | 25 |
| Amphoteric compound 1 | 3.2 | — |
| Cumene sulphonate | — | 6.8[1)] |
| Water | balance | balance |

[1)]This amount was necessary to obtain a clear solution.

One part by weight of the compositions was diluted with 20 parts by weight of water, and the diluted solutions were applied on the metal plates and washed away with tap water after 40 seconds. The washed-away soil was calculated by the computer program integrated in the meter, whereby for composition I according to the invention about 69% washed-away soil and for the reference product about 57% was obtained, although the amount of cumene sulphonate in composition II was 6.8% as compared to 3.2% amphoteric compound in composition I.

What is claimed is:

1. An alkaline concentrate in the form of a clear aqueous solution which, after dilution with water, is suitable for use as detergent, said concentrate comprising at least 4% by weight of a nonionic alkoxylate surfactant, which contains 2–12, alkyleneoxy groups having 2–4 carbon atoms, at least 50% of the alkyleneoxy groups being ethyleneoxy groups, at least 13% by weight of a complexing agent, the total amount of the nonionic alkoxylate surfactant and the complexing agent being at least 24% by weight, and 1–15% by weight of an amphoteric compound having the formula (II)

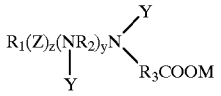

wherein $R_1$ is a hydrocarbon group having 4–20 carbon atoms, Z is the group CO, a group $(B)_nOCH_2CH(OH)CH_2$, wherein B is an oxyalkylene group having 2–4 carbon atoms and n is from 0 to 5, or the group $CH(OH)CH_2$, z is 0 or 1, $R_2$ is the group $—C_2H_4—$, or the group $—C_3H_6—$, Y is hydrogen or a group $R_3COOM$, y is 0–3, with the proviso that when z is 1 and Z is the group CO, y is 1–3, $R_3$ is $—CH_2—$ or $—C_2H_4—$ and M is hydrogen or a cation, as solubiliser.

2. The concentrate of claim 1, wherein the nonionic alkoxylate surfactant consists of compounds having the formula (Ia)

wherein R is a hydrocarbon having 8–18 carbon atoms, x is from 2 to 12 and A is an alkyleneoxy group having 2–4 carbon atoms, the number of ethyleneoxy groups being at least 50% of the total number of alkyleneoxy groups.

3. The concentrate of claim 1, wherein the nonionic alkoxylate surfactant has the formula (Ib)

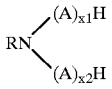

wherein R is a hydrocarbon group or an acyl group having 8–18 carbon atoms, A has the meaning stated in formula (Ia), and $x_1$ and $x_2$ are, independently of each other, 0–12, the sum of $x_1$ and $x_2$ being 2–12.

4. The concentrate of claim 3, wherein R is acyl and one of $x_1$ and $x_2$ is 0.

5. The concentrate of claim 1 wherein the amphoteric compound has the formula (III)

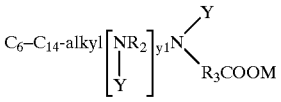

wherein $R_2$, $R_3$, M and Y have the meaning stated in formula (II) and $y_1$ is 0–2, the number of $R_3COOM$ groups being at least 2.

6. The concentrate of claim 1 wherein the amphoteric compound has the formula (IV)

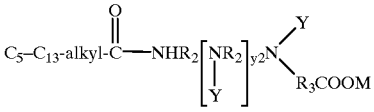

wherein $R_2$, $R_3$, Y and M have the meaning stated in formula (II) and $y_2$ is 0 or 1, the number of $R_3COOM$ groups being at least 2.

7. The concentrate of claim 1, wherein the amphoteric compound has the formula (V)

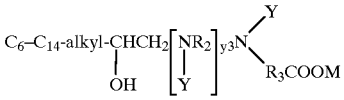

wherein $R_2$, $R_3$, Y and M have the meaning stated in formula (II) and $y_3$ is 0–2, the number of $R_3COOM$ groups being at least 2.

8. The concentrate of claim 1 wherein the amphoteric compound has the formula (VI)

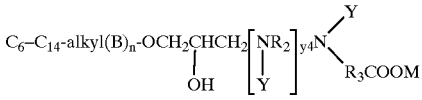

wherein $R_2$, $R_3$, B, Y, M and n have the meaning stated in formula (II) and $y_4$ is 0–2, the number of $R_3COOM$ groups being at least 2.

9. The concentrate of claim 1 wherein the complexing agents are inorganic phosphates or aminocarboxylates.

10. The concentrate of claim 9 wherein the complexing agents are sodium nitrilotriacetate (NTA), sodium ethlenediaminetetraacetate (EDTA), sodium diethylenetriaminepentaacetate (DTPA), sodium 1,3-propylenediaminetetraacetate (PDZ) and sodium hydroxyethylethlenediaminetriacetate (HEDTA).

11. A method of solubilizing an alkaline aqueous detergent concentrate to form a clear aqueous solution, said detergent concentrate containing at least 4% by weight of a nonionic alkoxylate surfactant which contains 2–12 alkyleneoxy groups having 2–4 carbon atoms, at least 50% of the alkleneoxy groups being ethyleneoxy groups, and at least 13% by weight of a complexing agent, said method comprising adding to said detergent concentrate from 1–15% by wieght of an amphoteric compound having the formula (II)

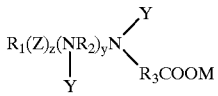

wherein $R_1$ is a hydrocarbon group having 4–20 carbon atoms, Z is the group CO, a group $(B)_nOCH_2CH(OH)CH_2$, wherein B is an oxyalkylene group having 2–4 carbon atoms and n is from 0 to 5, or the group $CH(OH)CH_2$, z is 0 or 1, $R_2$ is the group $—C_2H_4—$, or the group $—C_3H_6—$, Y is a group $R_3COOM$, y is 0–3, with the proviso that when z is 1 and Z is the group CO, y is 1–3, $R_3$ is $—CH_2—$ or $—C_2H_4—$ and M is hydrogen or a cation.

12. The concentrate of claim 3 wherein $x_2$ is 3–10.

13. The concentrate of claim 5 wherein $y_1$ is 1 or 0.

14. The concentrate of claim 7 wherein $y_1$ is 0 or 1.

15. The concentrate of claim 8 wherein $y_4$ is 1 or 0.

16. The concentrate of claim 2 wherein x is 3–10.

17. The concentrate of claim 3 wherein R is a hydrocarbon group and $x_1$ and $x_2$ are both different.

18. The concentrate of claim 1 wherein said nonionic alkoxylate surfactant contains 3–10 alkyleneoxy groups.

19. The concentrate of claim 1, wherein $R_1$ is a hydrocarbon group having 6–14 carbon atoms.

20. The concentrate of claim 1, wherein the amount of water in the concentrate makes up the remainder thereof.

21. The method of claim 12, wherein $R_1$ is a hydrocarbon group having 6–14 carbon atoms.

22. The method of claim 12, wherein the amount of water in the concentrate makes up the remainder thereof.

* * * * *